US010538948B1

(12) United States Patent
Johnson et al.

(10) Patent No.: US 10,538,948 B1
(45) Date of Patent: Jan. 21, 2020

(54) TILT LATCH APPARATUS AND SASHES INCORPORATING SAME

(71) Applicant: ANDERSEN CORPORATION, Bayport, MN (US)

(72) Inventors: Craig Johnson, North Oaks, MN (US); Sean Grainger, Woodbury, MN (US); Todd Bruchu, Lake Elmo, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 124 days.

(21) Appl. No.: 15/420,269

(22) Filed: Jan. 31, 2017

Related U.S. Application Data

(60) Provisional application No. 62/290,056, filed on Feb. 2, 2016.

(51) Int. Cl.

| | |
|---|---|
| ***E05D 15/22*** | (2006.01) |
| ***E05B 65/08*** | (2006.01) |
| ***E05C 9/04*** | (2006.01) |
| ***E05C 9/10*** | (2006.01) |

(52) U.S. Cl.
CPC ..... *E05D 15/22* (2013.01); *E05B 65/0864* (2013.01); *E05C 9/04* (2013.01); *E05C 9/10* (2013.01); *E05Y 2900/148* (2013.01)

(58) Field of Classification Search
CPC ..... E05C 2007/007; E05C 3/046; E05C 9/00; E05B 65/0841; E05B 65/0876; Y10S 292/47; Y10S 292/20; Y10S 292/37; E05D 15/22
See application file for complete search history.

(56) References Cited

U.S. PATENT DOCUMENTS

| | | | | |
|---|---|---|---|---|
| 4,578,903 | A * | 4/1986 | Simpson | E05D 15/22 49/175 |
| 4,791,756 | A | 12/1988 | Simpson | |
| 5,090,750 | A * | 2/1992 | Lindqvist | E05B 65/087 292/36 |
| 5,169,205 | A * | 12/1992 | James | B60J 9/02 292/21 |
| 5,244,238 | A * | 9/1993 | Lindqvist | E05B 65/0841 292/36 |
| 5,301,989 | A * | 4/1994 | Dallmann | E05B 65/0876 292/142 |
| 5,398,447 | A * | 3/1995 | Morse | E05B 53/003 292/6 |
| 5,585,155 | A | 12/1996 | Heikkila et al. | |
| 6,106,944 | A | 8/2000 | Heikkila et al. | |
| 6,183,024 | B1 | 2/2001 | Schultz et al. | |
| 6,210,792 | B1 | 4/2001 | Seethamraju et al. | |
| 6,260,251 | B1 | 7/2001 | Guhl | |
| 6,280,667 | B1 | 8/2001 | Koenig et al. | |
| 6,342,172 | B1 | 1/2002 | Finley | |
| 6,877,784 | B2 | 4/2005 | Kelley et al. | |
| 7,013,603 | B2 | 3/2006 | Eenigenburg et al. | |
| 7,070,211 | B2 | 7/2006 | Polowinczak et al. | |

(Continued)

*Primary Examiner* — Justin B Rephann
(74) *Attorney, Agent, or Firm* — Mueting, Raasch & Gebhardt, P.A.

(57) ABSTRACT

Tilt latch apparatus and sashes incorporating the same are described herein. The tilt latch apparatus tilt latch apparatus may provide a convenient mechanism for a user to release the tilt latches on a sash with one hand while controlling movement (e.g., rotation) of the sash with another hand.

15 Claims, 10 Drawing Sheets

(56) References Cited

U.S. PATENT DOCUMENTS

| | | | | |
|---|---|---|---|---|
| 7,070,215 | B2 | 7/2006 | Kelley et al. | |
| 7,165,791 | B2 * | 1/2007 | Rebel | E05B 63/185 292/137 |
| 7,322,619 | B2 | 1/2008 | Nolte et al. | |
| 7,412,800 | B2 * | 8/2008 | Maier | E06B 3/44 292/DIG. 47 |
| 7,607,262 | B2 | 10/2009 | Pettit et al. | |
| 7,874,598 | B2 * | 1/2011 | Chung | E05B 63/20 292/163 |
| 7,882,657 | B2 | 2/2011 | Duncan et al. | |
| 8,061,082 | B2 * | 11/2011 | Garries | E05B 9/08 49/181 |
| 8,132,369 | B2 | 3/2012 | Pettit et al. | |
| 8,955,255 | B2 * | 2/2015 | DeBoer | E05B 53/003 49/176 |
| 2003/0084614 | A1 * | 5/2003 | Pettit | E05B 5/003 49/185 |
| 2004/0168370 | A1 * | 9/2004 | Pettit | E05B 5/003 49/185 |
| 2004/0200150 | A1 * | 10/2004 | Kelley | E05B 53/003 49/185 |
| 2005/0016067 | A1 * | 1/2005 | Pettit | E05B 5/003 49/185 |
| 2007/0180770 | A1 * | 8/2007 | Flory | E05B 53/003 49/185 |
| 2008/0022728 | A1 * | 1/2008 | Flory | E05B 63/14 70/90 |
| 2008/0129054 | A1 * | 6/2008 | Tremble | E05B 15/102 292/33 |
| 2010/0038918 | A1 * | 2/2010 | Liang | E05B 9/08 292/2 |
| 2011/0192089 | A1 * | 8/2011 | Barton | E05B 63/20 49/394 |

* cited by examiner

TILT LATCH APPARATUS AND SASHES INCORPORATING SAME

RELATED APPLICATION

This application claims the benefit under 35 U.S.C. § 119 of U.S. Provisional Application Ser. No. 62/290,056 filed Feb. 2, 2016, entitled TILT LATCH APPARATUS AND SASHES INCORPORATING SAME, which is incorporated herein by reference in its entirety.

Tilt latch apparatus and sashes incorporating the tilt latch apparatus are described herein along with methods of using the same.

Fenestration units incorporating one or more movable sashes supported within a frame are well known. In some constructions, the sash and fenestration unit may be constructed to allow the sash to be tilted inward for, e.g., cleaning or other maintenance issues. To allow for tilting, the sash may be pivotally mounted in a frame, with the sash including one or more latch bolts assemblies installed in the sash. The latch bolt assemblies typically have a latch bolt biased outwardly to engage a portion of the frame in which the sash is located. Movement of the latch bolts inwardly to retract them allows for disengagement and tilting of the sash for, as described herein, cleaning or other maintenance purposes.

SUMMARY

Tilt latch apparatus and sashes incorporating the same are described herein. In one or more embodiments, the tilt latch apparatus may provide a common tilt latch retractor assembly which can be used to release the tilt latches on a sash with one hand while controlling movement (e.g., rotation) of the sash with another hand. A tilt latch apparatus as described herein may include more than one common tilt latch retractor assembly with each common tilt latch retractor assembly capable of retracting tilt latch bolts at both ends of a release rail of a sash as described herein.

In one or more embodiments, the tilt latch apparatus described herein may be provided as a modular unit that can be easily inserted into a tilt latch channel formed in the release rail of a sash by, e.g., sliding the tilt latch apparatus into the tilt latch channel from one end of the channel, inserting the tilt latch apparatus into the top of a channel (in a direction transverse to the length of the channel), etc. As a result, initial insertion of the tilt latch apparatus into the sash during manufacturing may be simplified. Further, replacement of a malfunctioning tilt latch in one or more embodiments of the tilt latch apparatus described herein may be simplified by allowing for easy removal and replacement of the tilt latch apparatus as an assembly. Alternatively, the tilt latch apparatus may be easily removed from a sash to allow for replacement of the malfunctioning parts. The repaired tilt latch apparatus may then be reinserted into the sash.

In one or more embodiments, the tilt latch apparatus and sashes incorporating the same as described herein may also provide reinforcement of the release rail on a sash including the tilt latch apparatus such that the release rail including the tilt latch apparatus is more resistant to mechanical deformation due to forces exerted on the release rail.

In one aspect, a sash apparatus as described herein may include a sash comprising a frame containing a panel therein, wherein the frame comprises a release rail located along one edge of the sash, wherein the release rail comprises a frame edge and a panel edge, wherein the panel edge faces an edge of the panel and the frame edge faces away from the panel edge, and wherein the release rail comprises an inner surface extending between the frame edge and the panel edge on one side of the sash and an outer surface facing extending between the frame edge and the panel edge on an opposite side of the sash; a tilt latch channel located in the release rail along the frame edge, wherein the tilt latch channel extends along a release rail axis extending between a first end of the release rail and a second end of the release rail, wherein the tilt latch channel occupies only a portion of a width of the release rail as measured in a direction transverse to a plane defined by the panel; a first latch bolt assembly in the tilt latch channel of the release rail proximate the first end of the release rail, wherein the first latch bolt assembly comprises a first latch bolt movable between an engagement position and a retracted position, wherein the first latch bolt extends past the first end of the release rail when in the engagement position; a second latch bolt assembly in the tilt latch channel of the release rail proximate the second end of the release rail, wherein the second latch bolt assembly comprises a second latch bolt movable between an engagement position and a retracted position, wherein the second latch bolt extends past the second end of the release rail when in the engagement position; and a common tilt latch retractor assembly positioned in the tilt latch channel between the first latch bolt assembly and the second latch bolt assembly, wherein the common tilt latch retractor assembly is operably connected to both the first latch bolt assembly and the second latch bolt assembly and configured to retract the latch bolts for both the first latch bolt assembly and the second latch bolt assembly inwardly towards the common tilt latch retractor from their respective engagement positions to their respective retracted positions at the same time when actuated, wherein the common tilt latch retractor assembly is positioned within a release rail volume defined by the frame edge, panel edge, inner surface, and outer surface.

In one or more embodiments of the sash apparatus described herein, the common tilt latch retractor assembly comprises: a driver positioned in the tilt latch channel between the first latch bolt assembly and the second latch bolt assembly; a first actuator extending between the driver and the first latch bolt assembly, wherein the first actuator is operably attached to the first latch bolt assembly; and a second actuator extending between the driver and the second latch bolt assembly, wherein the second actuator is operably attached to the second latch bolt assembly.

In one or more embodiments, actuation of the common tilt latch retractor assembly comprises moving the driver between a rest position and a retraction position to move the latch bolts for both the first latch bolt assembly and the second latch bolt assembly inwardly towards the common tilt latch retractor assembly from their respective engagement positions to their respective retracted positions.

In one or more embodiments of a sash apparatus including a common tilt latch retractor assembly as described herein in which actuation of the common tilt latch actuator comprises moving the driver between a rest position and a retraction position, moving the driver between the rest position and the retraction position comprises moving the driver member towards the panel edge of the release rail in a direction transverse to the release rail axis.

In one or more embodiments of a sash apparatus including a common tilt latch retractor assembly as described herein in which actuation of the common tilt latch actuator comprises moving the driver between a rest position and a retraction position, moving the driver between the rest position and the retraction position comprises rotating the driver. In one or more embodiments, rotating the driver comprises rotating the driver about a driver axis aligned with the release rail axis. In one or more embodiments, rotating the driver comprises rotating the driver about a driver axis transverse to the release rail axis. In one or more embodiments of a sash apparatus including a common tilt latch retractor assembly as described herein in which actuation of the common tilt latch actuator comprises moving the driver between a rest position and a retraction position, moving the driver between the rest position and the retraction position comprises sliding the driver in a direction aligned with the release rail axis.

In one or more embodiments of the sash apparatus described herein in which the common tilt latch retractor assembly includes first and second actuators, the first actuator and the second actuator are portions of a unitary actuator extending continuously from the first latch bolt assembly to the second latch bolt assembly.

In one or more embodiments of the sash apparatus described herein, the common tilt latch retractor assembly comprises a first common tilt latch retractor assembly of a plurality of common tilt latch retractor assemblies positioned in the tilt latch channel between the first latch bolt assembly and the second latch bolt assembly.

In one or more embodiments of the sash apparatus described herein, the sash comprises a window sash and the panel comprises a glazing panel. In one or more embodiments, the window sash comprises a movable window sash located in a window frame containing another window sash, wherein the movable window sash is movable between an open position and a closed position in the window frame. In one or more embodiments, the movable window sash comprises an upper sash of a double hung window unit.

In a second aspect, a tilt latch apparatus for a release rail of a sash as described herein may include: a housing configured for positioning in a tilt latch channel of a release rail of a sash, wherein the housing comprises a housing channel extending from a first end of the housing to a second end of the housing along a housing channel axis; a first latch bolt assembly in the housing channel proximate the first end of the housing, wherein the first latch bolt assembly comprises a first latch bolt movable between an engagement position and a retracted position, wherein the first latch bolt extends past the first end of the housing when in the engagement position; a second latch bolt assembly in the housing channel proximate the second end of the housing, wherein the second latch bolt assembly comprises a second latch bolt movable between an engagement position and a retracted position, wherein the second latch bolt extends past the second end of the housing when in the engagement position; and a common tilt latch retractor assembly positioned in the housing channel between the first latch bolt assembly and the second latch bolt assembly, wherein the common tilt latch actuator is operably connected to both the first latch bolt assembly and the second latch bolt assembly and configured to retract the latch bolts for both the first latch bolt assembly and the second latch bolt assembly inwardly towards the common tilt latch retractor from their respective engagement positions to their respective retracted positions at the same time when actuated.

In one or more embodiments of a tilt latch apparatus as described herein, the common tilt latch retractor assembly comprises: a driver positioned in the housing channel between the first latch bolt assembly and the second latch bolt assembly; a first actuator extending between the driver and the first latch bolt assembly, wherein the first actuator is operably attached to the first latch bolt assembly; and a second actuator extending between the driver and the second latch bolt assembly, wherein the second actuator is operably attached to the second latch bolt assembly.

In one or more embodiments of a tilt latch apparatus including a common tilt latch retractor assembly as described herein, actuation of the common tilt latch actuator comprises moving the driver between a rest position and a retraction position to move the latch bolts for both the first latch bolt assembly and the second latch bolt assembly inwardly towards the common tilt latch actuator from their respective engagement positions to their respective retracted positions.

In one or more embodiments of a tilt latch apparatus including a common tilt latch retractor assembly as described herein in which actuation of the common tilt latch actuator comprises moving the driver between a rest position and a retraction position, moving the driver between the rest position and the retraction position comprises moving the driver in a direction transverse to the housing channel axis.

In one or more embodiments of a tilt latch apparatus including a common tilt latch retractor assembly as described herein in which actuation of the common tilt latch actuator comprises moving the driver between a rest position and a retraction position, moving the driver between the rest position and the retraction position comprises rotating the driver. In one or more embodiments, rotating the driver comprises rotating the driver about a driver axis aligned with the housing channel axis. In one or more embodiments, rotating the driver comprises rotating the driver about a driver axis transverse to the housing channel axis.

In one or more embodiments of a tilt latch apparatus including a common tilt latch retractor assembly as described herein in which actuation of the common tilt latch actuator comprises moving the driver between a rest position and a retraction position, moving the driver between the rest position and the retraction position comprises sliding the driver in a direction aligned with the housing channel axis.

In one or more embodiments of the tilt latch apparatus described herein in which the common tilt latch retractor assembly includes first and second actuators, the first actuator and the second actuator are portions of a unitary actuator extending continuously from the first latch bolt assembly to the second latch bolt assembly.

In one or more embodiments of the tilt latch apparatus described herein, the common tilt latch actuator comprises a first common tilt latch actuator of a plurality of common tilt latch actuators positioned in the housing channel between the first latch bolt assembly and the second latch bolt assembly.

In a third aspect, one or more embodiments of the methods described herein may include: sliding a sash within a fenestration unit frame such that a release rail of the sash is moved away from a frame member of the fenestration unit frame, wherein the release rail comprises a frame edge facing the frame member and a panel edge facing away from the frame member, wherein the panel edge faces an edge of a panel contained in the sash, and wherein the release rail comprises an inner surface extending between the frame edge and the panel edge on one side of the sash and an outer surface facing extending between the frame edge and the panel edge on an opposite side of the sash; moving a first latch bolt of a first latch bolt assembly in the release rail from an engagement position to a retracted position, wherein the first latch bolt extends past a first end of the release rail when in the engagement position; moving a second latch bolt of a second latch bolt assembly in the release rail from an engagement position to a retracted position, wherein the second latch bolt extends past a second end of the release rail when in the engagement position; wherein moving the first latch bolt and the second latch bolt from their respective engagement positions to their respective retracted positions comprises actuating a common tilt latch retractor assembly located within a release rail volume defined by the frame edge, panel edge, inner surface, and outer surface of the release rail, wherein the common tilt latch retractor assembly is operably connected to both the first latch bolt assembly and the second latch bolt assembly, and wherein actuating the common tilt latch retractor assembly comprises actuating the common tilt latch retractor assembly with one hand and wherein the actuating retracts the latch bolts for both the first latch bolt assembly and the second latch bolt assembly inwardly towards the common tilt latch retractor assembly from their respective engagement positions to their respective retracted positions at the same time.

In one or more embodiments of the methods described herein, sliding the sash exposes the frame edge of the release rail.

In one or more embodiments of the methods described herein, the method further comprises rotating the sash within the fenestration unit frame after actuating the common tilt latch retractor assembly.

In one or more embodiments of the methods described herein, actuating the common tilt latch retractor assembly comprises moving a driver between a rest position and a retraction position to retract the latch bolts for both the first latch bolt assembly and the second latch bolt assembly inwardly towards the common tilt latch actuator from their respective engagement positions to their respective retracted positions, wherein moving the driver between the rest position and the retraction position comprises moving the driver towards the panel edge of the release rail in a direction transverse to a release rail axis extending between the first and second latch bolt assemblies.

In one or more embodiments of the methods described herein, actuating the common tilt latch retractor assembly comprises moving a driver between a rest position and a retraction position to retract the latch bolts for both the first latch bolt assembly and the second latch bolt assembly inwardly towards the common tilt latch actuator from their respective engagement positions to their respective retracted positions, wherein moving the driver between the rest position and the retraction position comprises rotating the driver. In one or more embodiments, rotating the driver comprises rotating the driver about an actuator axis aligned with the release rail axis. In one or more embodiments, rotating the driver comprises rotating the driver about an actuator axis transverse to the release rail axis.

In one or more embodiments of the methods described herein, actuating the common tilt latch retractor assembly comprises moving a driver between a rest position and a retraction position to retract the latch bolts for both the first latch bolt assembly and the second latch bolt assembly inwardly towards the common tilt latch actuator from their respective engagement positions to their respective retracted positions, wherein moving the driver between the rest position and the retraction position comprises sliding the driver in a direction aligned with the release rail axis.

Unless otherwise explicitly limited herein, the term "fenestration unit" may include windows having one or more sliding sashes. The sliding sash may move vertically or horizontally within the frame of the fenestration unit. Non-limiting examples of fenestration units may include, e.g., double hung windows including a sash which moves vertically, sliding windows including a sash which moves horizontally, etc. If used in a horizontally sliding sash, the tilt latch apparatus described herein may be located in a vertical member typically referred to as a stile, but for the purposes of the present invention, such a vertical member will function as a "release rail" as described herein if it includes a tilt latch apparatus as described herein.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other only and, depending on the orientation of the tilt latch apparatus and sashes when used, may or may not accurately describe the relative positions of the recited features with respect to the ground.

The above summary is not intended to describe each embodiment or every implementation of the tilt latch apparatus and sashes and methods of using the same as described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
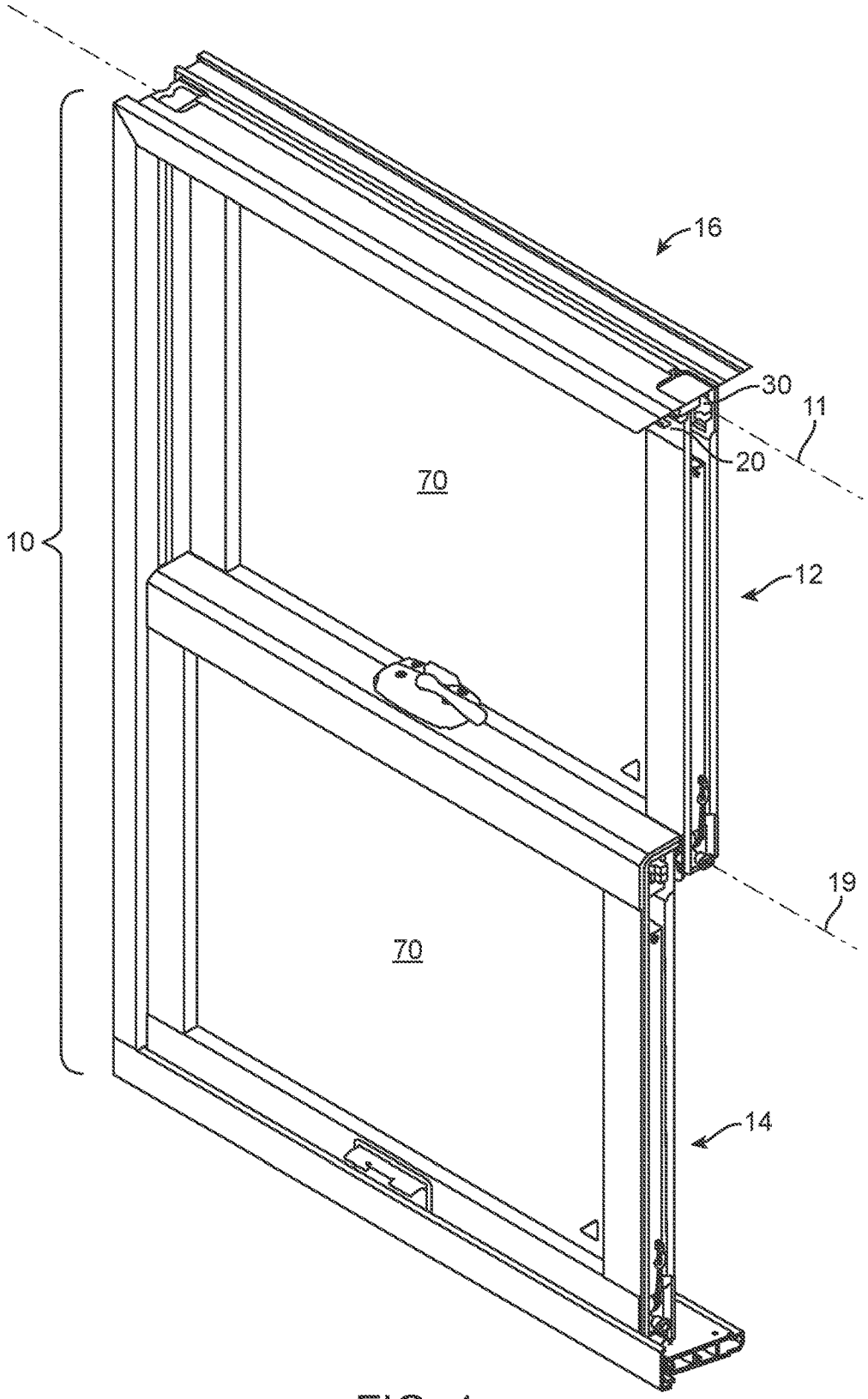
FIG. 1 is a perspective view of one embodiment of a fenestration unit in the form of a double hung window in which the tilt latch apparatus and sashes described herein may be used.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

Figure 2:
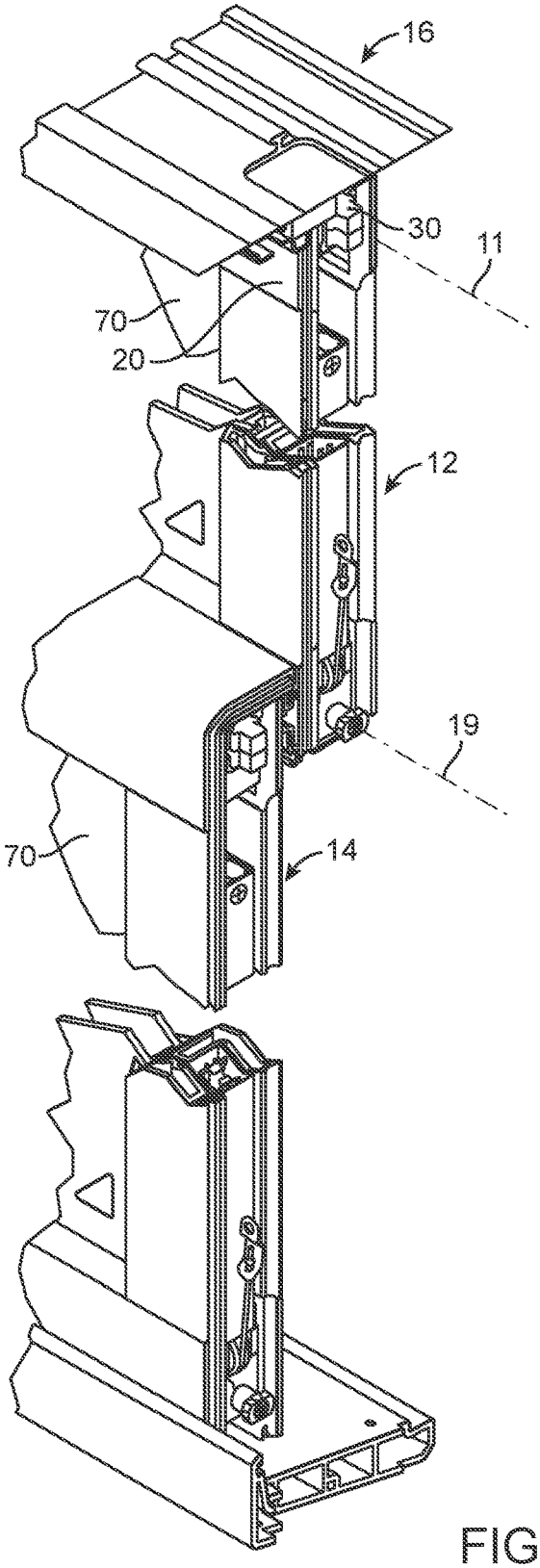
FIG. 2 is an enlarged view depicting one end of the release rail in the upper sash of the double hung window of FIG. 1.

One illustrative embodiment of a fenestration unit in the form of a double hung window 10 including an upper sash 12 containing a glazing panel 70 and a lower sash 14 containing a glazing panel 70 is depicted in FIGS. 1 and 2. The upper and lower sashes 12 and 14 are contained within a fenestration unit frame 16, with one of the frame members removed to expose one side of the upper and lower sashes 12 and 14 of the window 10. In particular, one end of the release rail 20 of upper sash 12 is depicted with the release rail 20 butted up against the upper frame member of fenestration unit frame 16 with the upper sash 12 in its closed position.

The fenestration unit frame members, along with release rails and other frame members of the sashes in fenestration units described herein may be constructed of any suitable material or combination of materials, wood, metal, polymers, fiberglass, etc. In one or more embodiments, the frame members may be manufactured of an extruded material which may include fibers and a polymer, pultruded materials, etc. Examples of some potentially suitable constructions for frame components that may be used to construct sashes as described herein may include those described in, e.g., U.S. Pat. No. 5,585,155 (Heikkila et al.); U.S. Pat. No. 6,106,944 (Heikkila et al.); U.S. Pat. No. 6,210,792 Seethamraju et al.); U.S. Pat. No. 6,260,251 (Guhl); U.S. Pat. No. 6,280,667 (Koenig et al.); U.S. Pat. No. 6,342,172 (Finley); etc.

Although the depicted fenestration unit in the form of window 10 includes a rectangular fenestration unit frame 16 along with rectangular sashes 12 and 14, frames and/or sashes located in fenestration units incorporating the tilt latch retainer apparatus described herein may take other shapes in one or more alternative embodiments.

In the depicted embodiment, release rail 20 of upper sash 12 defines a release rail axis 11 that is horizontal in orientation when the window 10 is installed in an opening. Although the release rail 20 and with release rail axis 11 are horizontal in a double hung window, the release rails in other fenestration units such as, e.g., sliding windows, patio doors, etc. may be positioned in other orientations such as, e.g., vertical.

Furthermore, although the illustrative embodiment of double hung window 10 includes glazing panels 70 in sashes 12 and 14, it should be understood that in other embodiments of fenestration units incorporating the tilt latch apparatus described herein, the panels in one or more of the sashes may or may not be glazing panels. For example, in one or more embodiments, a panel in a sash of a fenestration unit incorporating a tilt latch apparatus as described herein may be a solid panel constructed of wood or other materials.

Figure 1A:
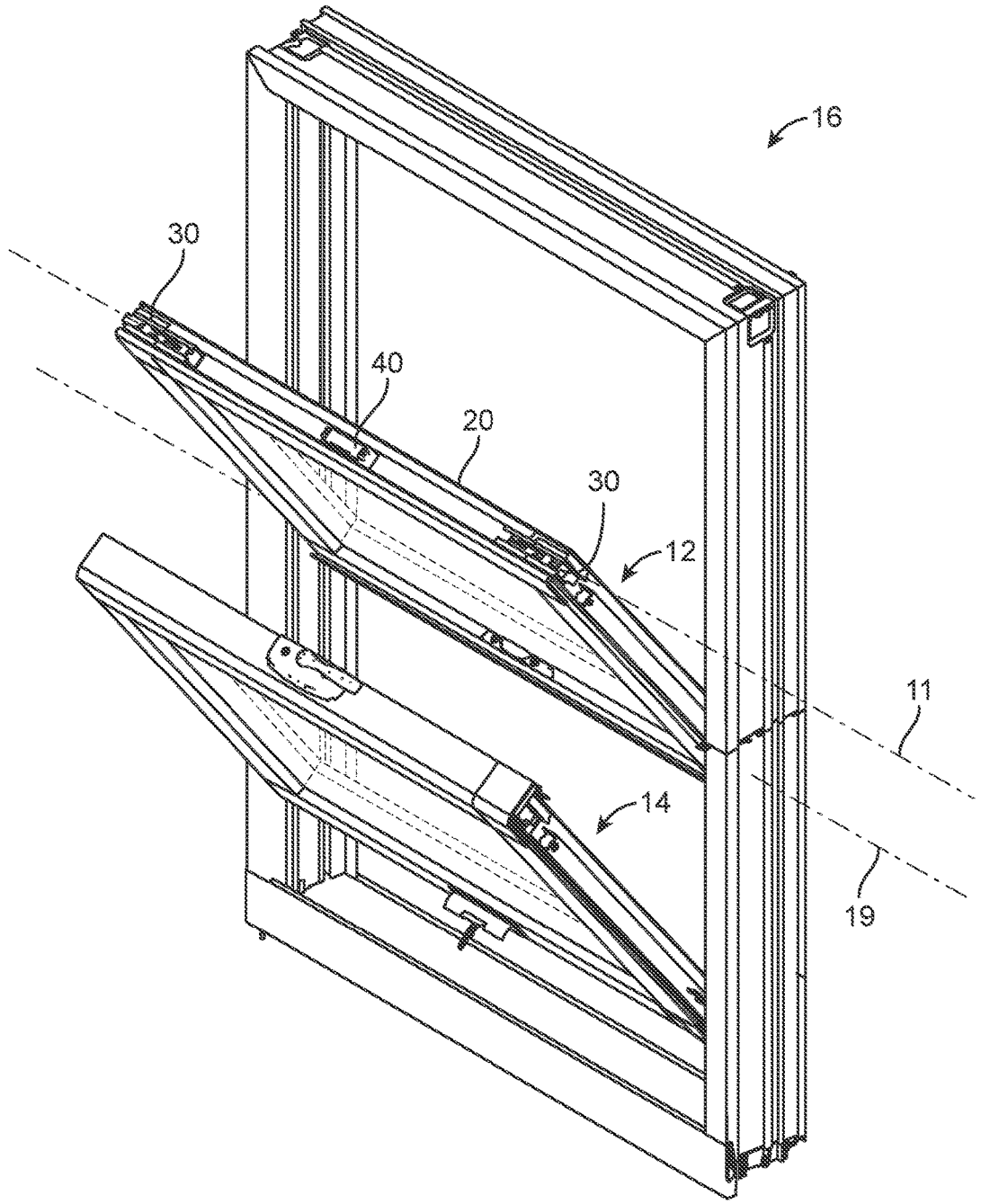
FIG. 1A is a perspective view of the illustrative embodiment of the fenestration unit of FIG. 1 with the upper and lower sashes tilted outward.

In the depicted embodiment of window 10, the upper sash 12 includes tilt latches 30 located at opposite ends of the release rail 20, although only one tilt latch 30 is seen in the views depicted in FIGS. 1 and 2. The upper sash 12 is pivotally mounted in the fenestration unit frame 16 for rotation about a tilt axis 19 that extends through the lower rail of the upper sash 12 when the tilt latches 30 are released. The upper sash 12 is depicted as pivotally rotated about tilt axis 19 in FIG. 1A after release of the latch bolt assemblies in the tilt latch retainer apparatus 30.

Figure 3:
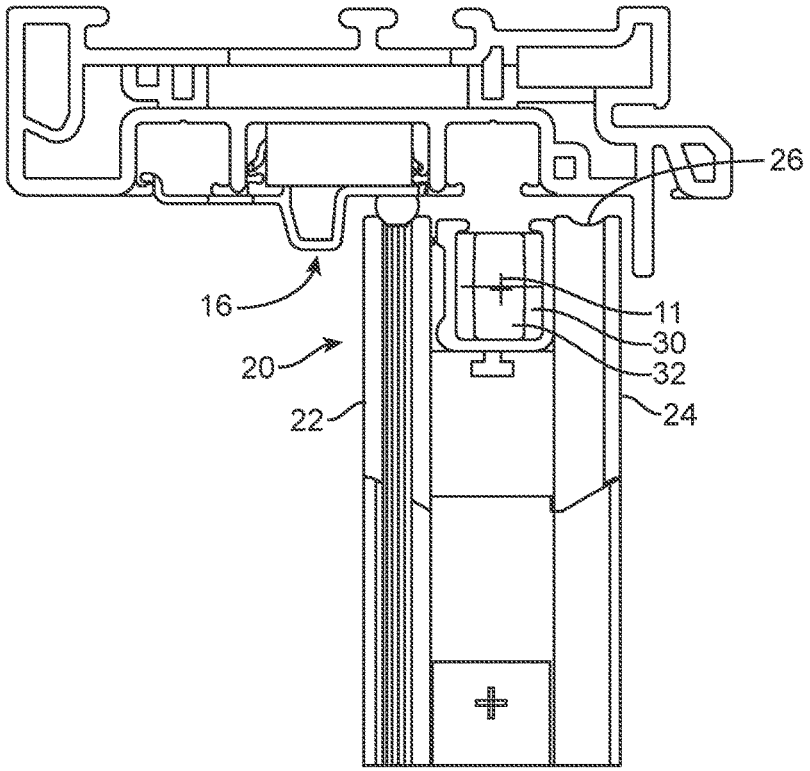
FIG. 3 is an enlarged end view of the junction between the release rail of the upper sash and the fenestration unit frame as seen in FIG. 2 viewed in a direction aligned with the release rail axis.
Figure 4:
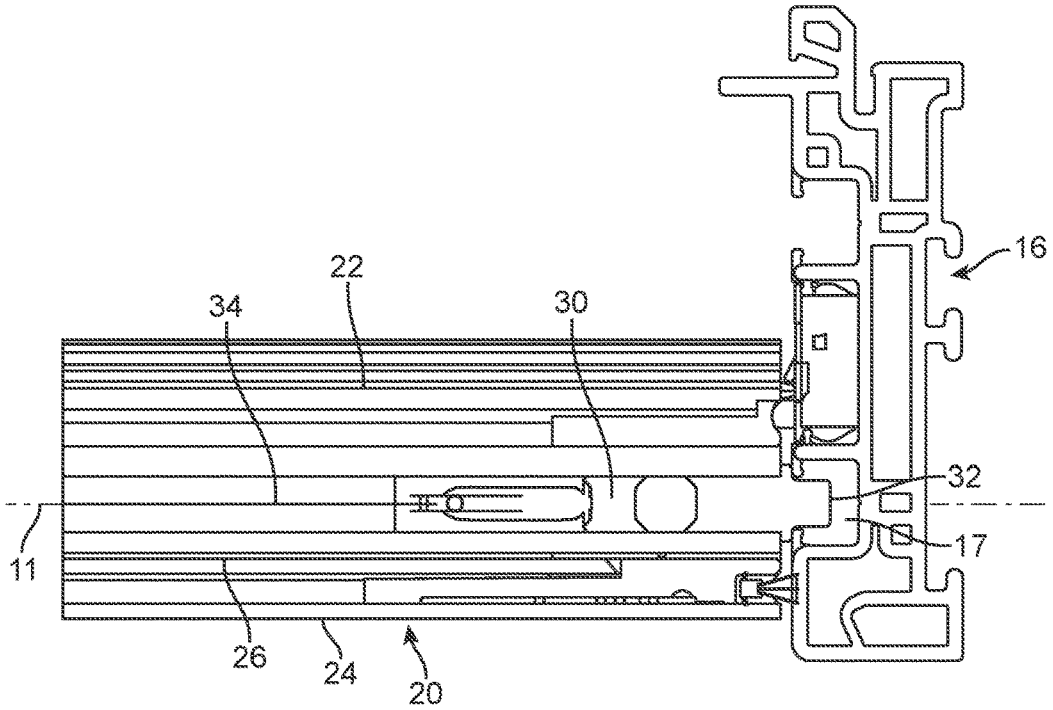
FIG. 4 is an enlarged top plan view of the junction between the release rail of the upper sash and a side frame member of the fenestration unit frame.

An enlarged end view of the junction between release rail 20 and the upper frame member of fenestration unit frame 16 (which is depicted in cross-section) is depicted in FIG. 3, while an enlarged top plan view of the junction between release rail 20 and a side frame member of the fenestration unit frame 16 (which is depicted in cross-section) is depicted in FIG. 4. A portion of the illustrative embodiment of release rail 20 is depicted in FIG. 5, along with one illustrative embodiment of a common tilt latch retractor assembly which may be used to retract the latch bolts in sashes as described herein.

Figure 5:
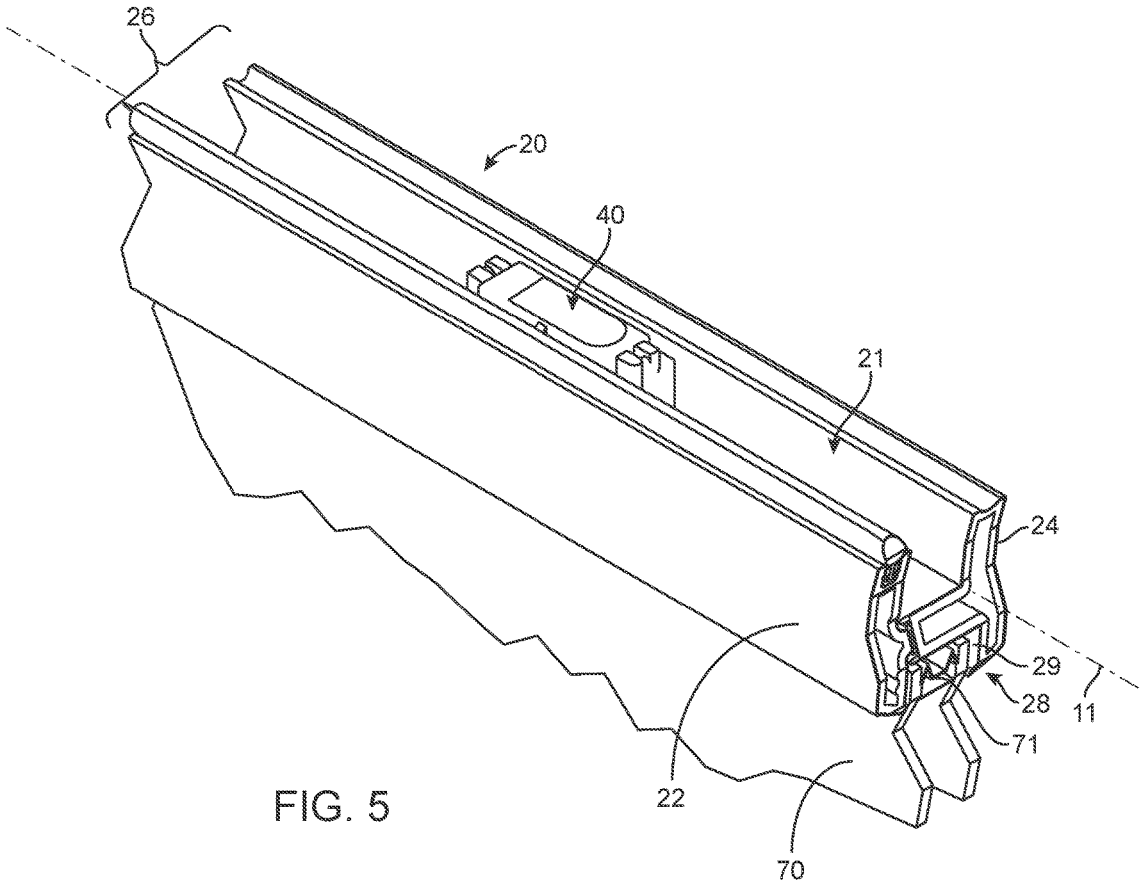
FIG. 5 is a perspective view of portion of the illustrative embodiment of release rail of a sash as described herein containing one illustrative embodiment of a common tilt latch retractor assembly as described herein.

Referring to FIGS. 3-5, the release rail 20 includes a frame edge 26 and a panel edge 28. The panel edge 28 faces an edge 71 of the glazing panel 70 and the frame edge 26 faces away from the panel edge 29. Furthermore, the frame edge 26 faces the frame member of fenestration unit frame 16 against which the frame edge 26 abuts when the upper sash 12 is closed within the fenestration unit frame 16. The release rail 20 further includes an inner surface 22 extending between the frame edge 26 and the panel edge 28 along with an outer surface 24 on an opposite side of the release rail 20 which also extends from the frame edge 26 to the panel edge 28. Taken together, the frame edge 26, inner surface 22, outer surface 24, and panel edge 28 define a release rail volume for the release rail 20.

In the depicted illustrative embodiment of release rail 20, a channel 29 is provided in the panel edge 28 of the release rail 20 into which one edge 71 of a glazing panel 70 may be received. In one or more embodiments, the edge 71 of the glazing panel 70 is located between the inner surface 22 and outer surface 24 when located in channel 29.

Although release rail 20 includes surfaces identified as an inner surface 22 and an outer surface 24, it should be understood that the surfaces may face any direction when a fenestration unit incorporating a sash including release rail 20 is installed within an opening. In other words, inner surface 22 may face the exterior of the building and/or outer surface 24 may face an interior of a building. The terms inner and outer as used herein are merely convenient terms to describe the structure of release rail 20.

The illustrative embodiment of release rail 20 as depicted in, e.g., FIG. 5, includes a tilt latch channel 21 located in the release rail 20 along the frame edge 26. In one or more embodiments, the tilt latch channel 21 extends along a release rail axis 11 extending between a first end of the release rail 20 and a second end of the release rail 20. In one or more embodiments, the tilt latch channel 21 occupies only a portion of the width of the release rail 20 as measured in a direction transverse to a plane defined by the glazing panel 70.

In one or more embodiments, the upper sash 12 also includes a pair of latch bolt assemblies located in the tilt latch channel 21 of the release rail 20. A first latch bolt assembly 30 is typically located proximate a first end of the release rail 20, e.g., the end of the release rail 20 seen in FIGS. 1 and 2, and a second latch bolt assembly 30 is located in the tilt latch channel 21 proximate a second end of the release rail 20, e.g., the end of release rail 20 located opposite from the end seen in FIGS. 1 and 2.

Each of the latch bolt assemblies 30 included in the tilt latch channel 21 of release rail 20 includes a latch bolt 32 movable between an engagement position and a retracted position. In the engagement position, the latch bolt 32 extends past the end of the release rail 20. In one or more embodiments, the latch bolt 32 may be located within a channel 17 in the frame member of fenestration unit frame 16 that faces the end of the release rail 20 (see, e.g., FIG. 4). As a result, the latch bolt 32 is retained within channel 17 until it is retracted inwardly along the direction of release rail axis 11. Retention of the latch bolt 32 in channel 17 also prevents rotation of the upper sash 12 about the lower rail axis 19 as discussed herein.

The illustrative embodiment of the tilt latch apparatus may, in one or more embodiments, include a common tilt latch retractor assembly positioned in the tilt latch channel of a release rail. In one or more embodiments, the common tilt latch retractor assembly used in tilt latch apparatus described herein is operably connected to the latch bolt assemblies located at each end of the release rail and is configured to retract the latch bolts of those latch bolt assemblies inwardly towards the common tilt latch retractor from the respective engagement positions of those latch bolts to their respective retracted positions. In one or more embodiments, movement of the latch bolts in both latch bolt assemblies located at opposite ends of the release rail occurs at the same time when the common tilt latch retractor assembly is actuated.

Further, in one or more embodiments, the common tilt latch retractor assembly is positioned within the release rail volume defined by the frame edge, panel edge, inner surface, and outer surface of the release rail in which the common tilt latch retractor assembly is positioned. Locating the common tilt latch retractor assembly in the release rail volume may, in one or more embodiments, allow the release rail of the sash to be fully engaged with the top frame member of a fenestration unit frame such that the sash can be in its closed position. Movement of the release rail of the sash away from the frame member to expose the frame edge of the release rail allows a user access to the common tilt latch retractor assembly.

One illustrative embodiment of a common tilt latch retractor assembly 40 is depicted in the tilt latch channel 21 of FIG. 5. Operation of the illustrative embodiment of common tilt latch retractor assembly 40 can be further described in connection with FIGS. 6-9.

Figures 6, 7:
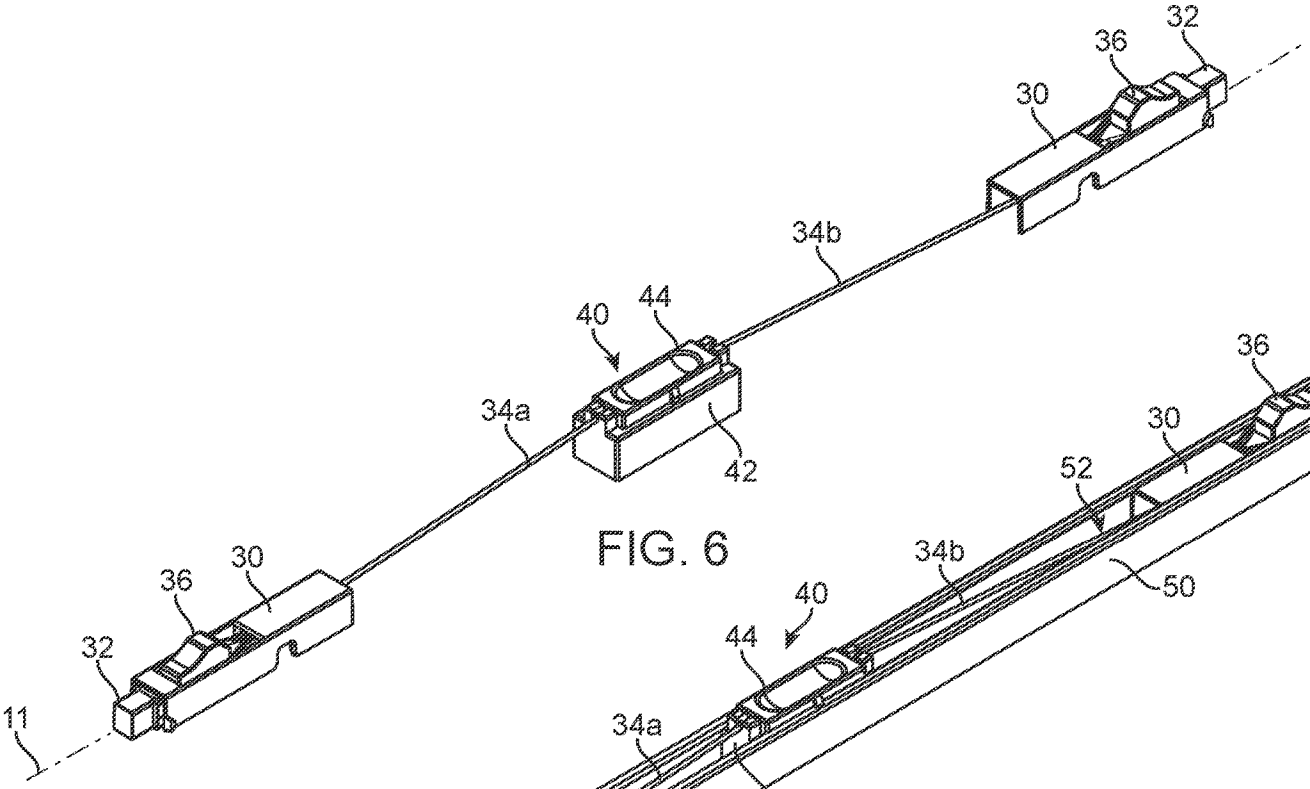
FIG. 6 depicts components of one illustrative embodiment of a tilt latch apparatus as described herein removed from a sash.
FIG. 7 depicts the components of the illustrative embodiment of a tilt latch apparatus as depicted in FIG. 7 located in a housing.

In particular, the components of the illustrative embodiment of a tilt latch apparatus are depicted in FIG. 6. The depicted apparatus includes a pair of latch bolt assemblies 30, each of which includes a latch bolt 32 depicted in its engagement position along release rail axis 11. The tilt latch apparatus further includes a common tilt latch retractor assembly 40 connected to both of the latch bolt assemblies 30 through actuators 34*a* and 34*b* (which may be collectively referred to as actuator 34 herein). In one or more embodiments, the actuators 34*a* and 34*b* may be portions of a unitary actuator that extends continuously between the latch bolt assemblies 30 located at opposite ends of the tilt latch apparatus as described herein.

Figure 8:
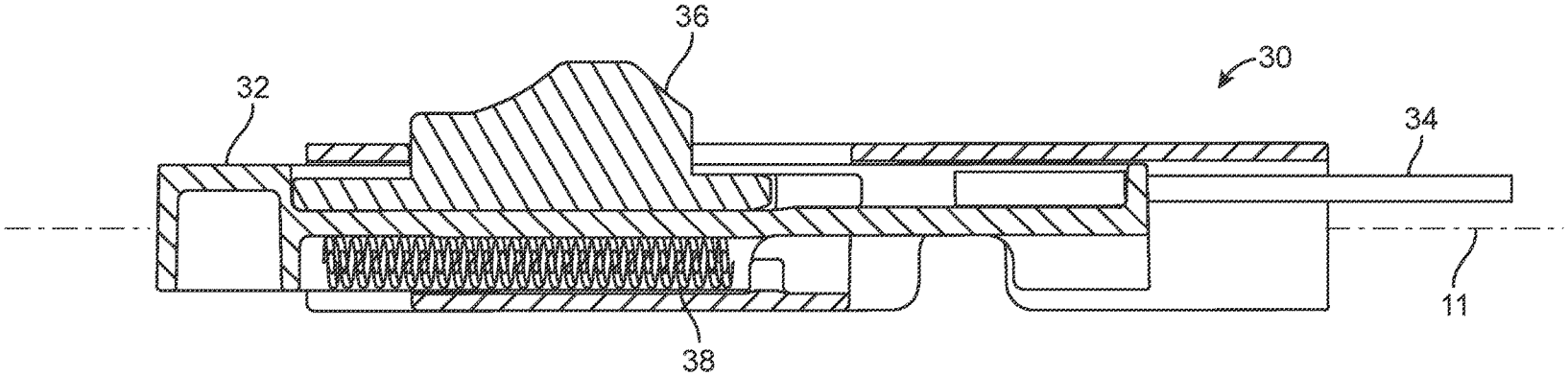
FIG. 8 is a cross-sectional view of one illustrative embodiment of a latch bolt assembly that may be used in a tilt latch apparatus as described herein.

As seen in the cross-sectional view of FIG. 8, the illustrative embodiment of latch bolt assembly 30 includes latch bolt 32, and actuator 34 attached thereto and a thumb lever 36 which is also attached to the latch bolt 32. Latch bolt 32 is biased outwardly in its engagement position by a resilient biasing member 38 such as e.g., a spring or other structure capable of providing a biasing force on the latch bolt 32. Examples of other potentially suitable latch bolt assemblies and their operation may be described herein may be described in, e.g., U.S. Pat. No. 4,791,756 (Simpson), U.S. Pat. No. 6,183,024 (Schultz et al.), U.S. Pat. No. 6,877,784 (Kelley et al.), U.S. Pat. No. 7,322,619 (Nolte et al.), U.S. Pat. No. 7,607,262 (Pettit et al.), etc.

A tension force delivered through actuator 34 can be used to retract latch bolt 32 along release rail axis 11. That tension force may, in one or more embodiments, be delivered using the common tilt latch retractor assembly 40 positioned in the tilt latch channel 21 of a release rail 20 between the latch bolt assemblies located at opposite ends of the release rail as described herein.

Figure 9:
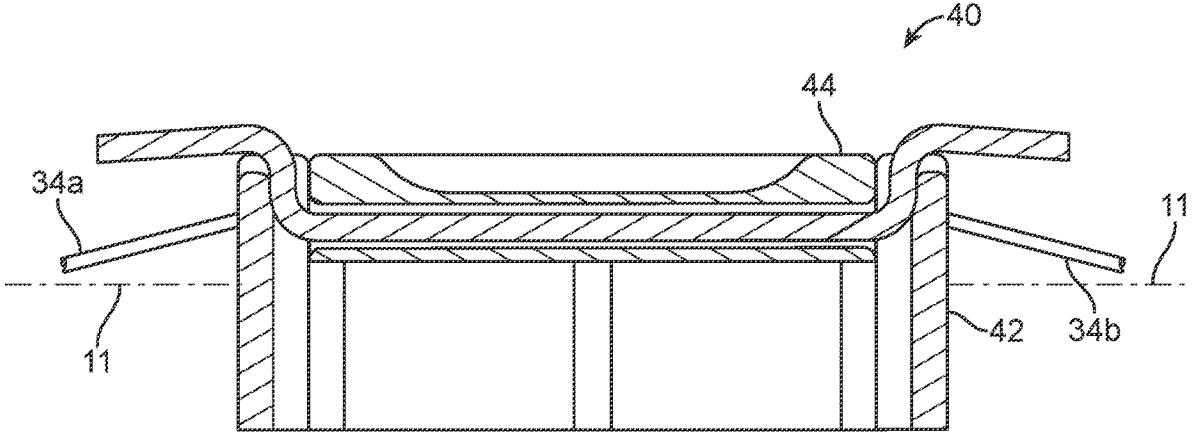
FIG. 9 is a cross-sectional view of one illustrative embodiment of a common tilt latch retractor assembly, with the cross-sectional view being taken in a plane aligned with a glazing panel located in a sash carrying the tilt latch apparatus using the common tilt latch retractor assembly.

In one or more embodiments, the common tilt latch retractor assembly used in a tilt latch apparatus as described herein may, in one or more embodiments such as that depicted in FIGS. 6, 7, and 9, include a driver 44 positioned in a base 42 located in, e.g., the tilt latch channel 21 of release rail 20. As discussed herein, a first actuator extends between the driver 44 and the latch bolt assembly 30 located at one end of the release rail 20, while a second actuator extends between the driver 44 and the latch bolt assembly 30 located at the opposite end of the release rail 20.

In one or more embodiments, actuation of the illustrative embodiment of common tilt latch retractor assembly 40 involves moving the driver 44 from a rest position to a retraction position. Movement of the driver 44 from a rest position seen in, e.g., the cross-sectional view of FIG. 9 as well as in FIGS. 6 and 7, to its retraction position. In this depicted illustrative embodiment, driver 44 is in the form of a pushbutton which is depressed downwardly in a direction transverse to the release rail axis 11. In the context of release rail 20, movement of the driver 44 from its rest position to the retraction position may be described as moving the driver towards the panel edge 28 of the release rail 20 in a direction transverse to the release rail axis 11.

Further, the actuator 34 of the depicted illustrative embodiment is in the form of a flexible cord and is positioned beneath the driver 44. As a result, when driver 44 is depressed downwardly, the actuator 34 is deflected downwardly drawing both segments 34*a* and 34*b* of actuator 34 towards the common tilt latch retractor assembly. As a result, both segments of the actuator 34 transmit a tension force to the latch bolts 32 in the latch bolt assemblies 30 which results in retraction of the latch bolts 32 from their engagement position to their retracted position.

In one or more embodiments of tilt latch apparatus as described herein, the various components of a tilt latch apparatus such as, e.g., latch bolt assemblies and one or more common tilt latch retractor assemblies, may be provided within a housing such that the tilt latch apparatus is provided as a modular unit that is configured for positioning in a tilt latch channel of a release rail of a sash.

One illustrative embodiment of a housing 50 is depicted in FIG. 7 in connection with illustrative embodiments of latch bolt assemblies 30 and a common tilt latch retractor assembly 40 connected to the latch bolt assemblies 30 by an actuator 34 as described herein. The housing 50 may be described as including a housing channel 52 extending from a first and 54 of the housing 52 a second and 56 of the housing 50. The housing 50 may include a housing channel 52 and both the housing 50 and the housing channel 52 may be described as extending along a housing channel axis which, in the depicted illustrative embodiment, is aligned with the release rail axis 11 when the housing 50 is located in a tilt latch channel of a release rail of a sash as described herein. Such an arrangement is not, however, required. In other words, the housing channel axis may, in one or more alternative embodiments, be offset from release rail axis as defined in a release rail containing a housing as described herein.

In the illustrative embodiment of tilt latch apparatus depicted in FIG. 7, the latch bolts 32 of the latch bolt assemblies 30 may be described as extending past their respective housing ends 54 or 56 when those latch bolts are in their respective engagement positions.

In one or more embodiments, the housing 50 may be formed as a one piece completely integral article which may be, e.g., extruded in a continuous process. Such a construction is not, however, required. Further, the housing 50 may be constructed of one or more suitable materials such as, e.g., metals, plastics, wood, composites, etc.

Although the illustrative embodiments of tilt latch apparatus as described herein include only a single common tilt latch retractor assembly, one or more alternative embodiments of tilt latch apparatus as described herein may include two or more common tilt latch retractor assemblies. In one or more embodiments, however, any common tilt latch retractor assemblies used in connection with the tilt latch apparatus as described herein may be used to move latch bolts in latch bolt assemblies at opposite ends of a release rail of a sash from their engagement positions to their retracted positions at the same time.

Figures 10, 11, 12:
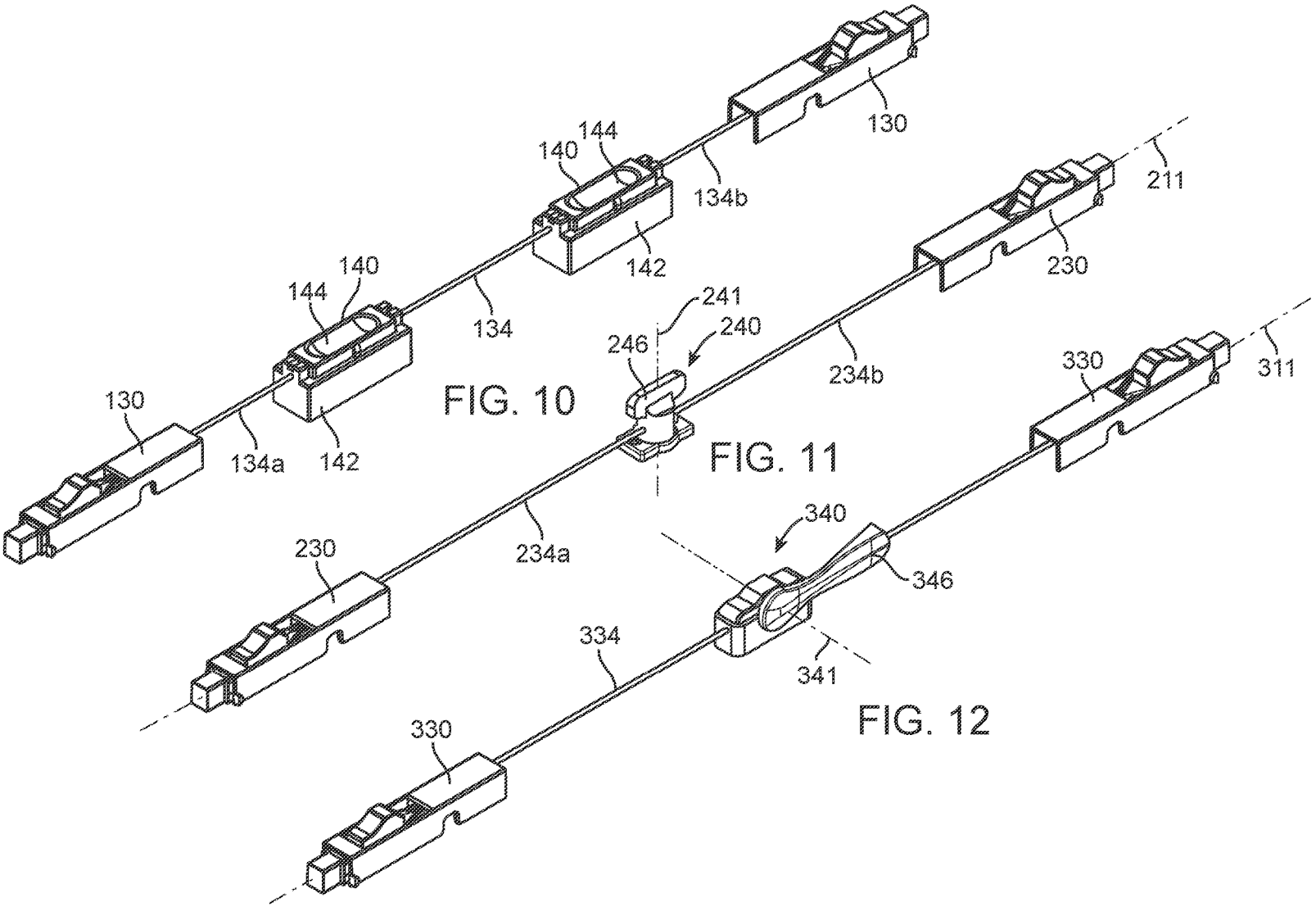
FIG. 10 depicts another illustrative embodiment of a tilt latch apparatus as described herein.
FIG. 11 depicts another illustrative embodiment of a tilt latch apparatus as described herein.
FIG. 12 depicts another illustrative embodiment of a tilt latch apparatus as described herein.

FIG. 10 depicts one illustrative embodiment of a tilt latch apparatus as described herein that includes two common tilt latch retractor assemblies 140, along with a pair of latch bolt assemblies 130 connected to the actuator 134. Each of the common tilt latch retractor assemblies 140 includes, as described herein, a base 142 and a driver 144 which may, in one or more embodiments, be similar to those described above in connection with FIG. 9. Although the depicted illustrative embodiment of the tilt latch apparatus depicted in FIG. 10 includes two common tilt latch retractor assemblies 140 that are of the same construction, one or more alternative embodiments of tilt latch apparatus described herein that include two or more common tilt latch retractor assemblies may include at least two different common tilt latch retractor assemblies.

Tilt latch apparatus that include two or more common tilt latch retractor assemblies may allow for more convenient right or left-handed release of the latch bolt assemblies 130 by a user. In one or more embodiments, both of the common tilt latch retractor assemblies 140 can be operably connected to both of the latch bolt assemblies 130 such that operation of either of the common tilt latch retractor assemblies 140 retracts the latch bolts in both of the latch bolt assemblies 130.

In one or more alternative embodiments, the common tilt latch retractor assemblies used in tilt latch apparatus as described herein may rely on rotation to draw the actuator segments towards the common tilt latch retractor assembly. In such embodiments, the driver may be described as moving between its rest position and its retraction position through rotation of the driver.

FIG. 11 depicts one illustrative embodiment of a tilt latch apparatus as described herein in which rotation is used to release the latch bolts in the latch bolt assemblies. In particular, the depicted illustrative embodiment of the tilt latch apparatus includes latch bolt assemblies 230 at each end along with a common tilt latch retractor assembly 240 operably connected to the latch bolt assemblies 230 by actuator segments 234*a* and 234*b* (which, as described herein, may form different segments of a continuous actuator or may be separate and discrete actuators that are not continuous through the common tilt latch retractor assembly 240). Rotation of the driver 246 of the common tilt latch retractor assembly 240 about driver axis 241 may, in one or more embodiments, retract the latch bolts in the latch bolt assemblies 230. In an embodiment such as that depicted in FIG. 11, that rotation may be described as being about a driver axis 241 that is transverse to the release rail axis 211. In alternative embodiments, however, a common tilt latch retractor assembly used in connection with the tilt latch apparatus as described herein may involve rotation about a driver axis that is aligned with the release rail axis 211.

FIG. 12 depicts another illustrative embodiment of a tilt latch apparatus as described herein in which rotation is used to release the latch bolts in the latch bolt assemblies. In particular, the depicted illustrative embodiment of the tilt latch apparatus includes latch bolt assemblies 330 at each end along with a common tilt latch retractor assembly 340 operably connected to the latch bolt assemblies 330 by actuator 334. Rotation of the driver 346 of the common tilt latch retractor assembly 340 about driver axis 341 may, in one or more embodiments, retract the latch bolts in the latch bolt assemblies 330. In an embodiment such as that depicted in FIG. 12, that rotation may be described as being about a driver axis 341 that is transverse to the release rail axis 311.

Figure 12A:
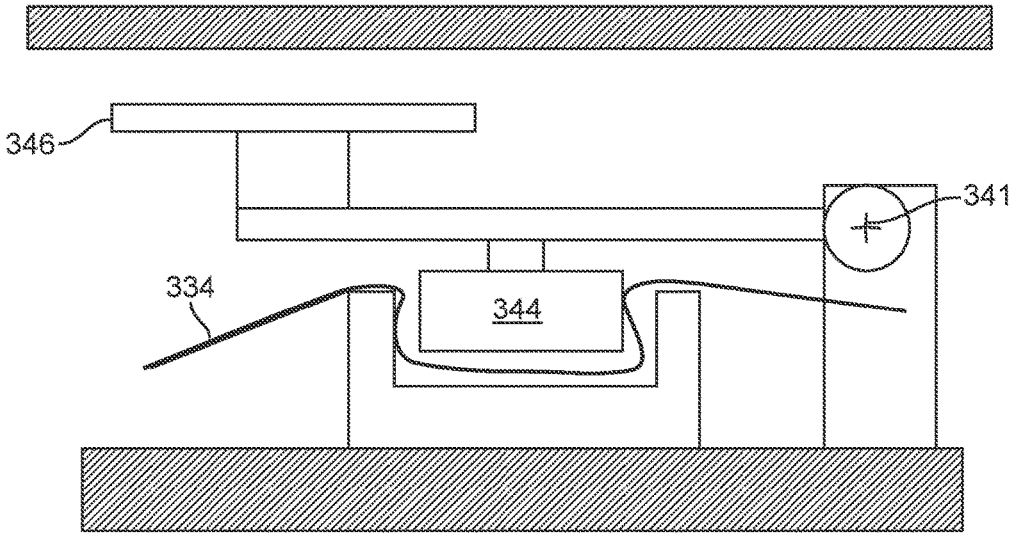
FIG. 12A depicts one potential variation in the mechanism used in the common tilt latch retractor assembly of the tilt latch apparatus depicted in FIG. 12.

FIG. 12A depicts one illustrative embodiment of a common tilt latch retractor assembly in which rotation about a driver axis 341 of the driver 346 forces a plunger 344 two deflect actuator 334 in base 342 in a manner similar to that described in connection with, e.g., the common tilt latch retractor assembly depicted in FIG. 9. One potential benefit of such an arrangement as that depicted in FIG. 12A is that the driver 346 takes advantage of a lever arm to potentially reduce the force required to release the latch bolts in the latch bolt assemblies connected to actuator 334.

Figures 13, 14, 15:
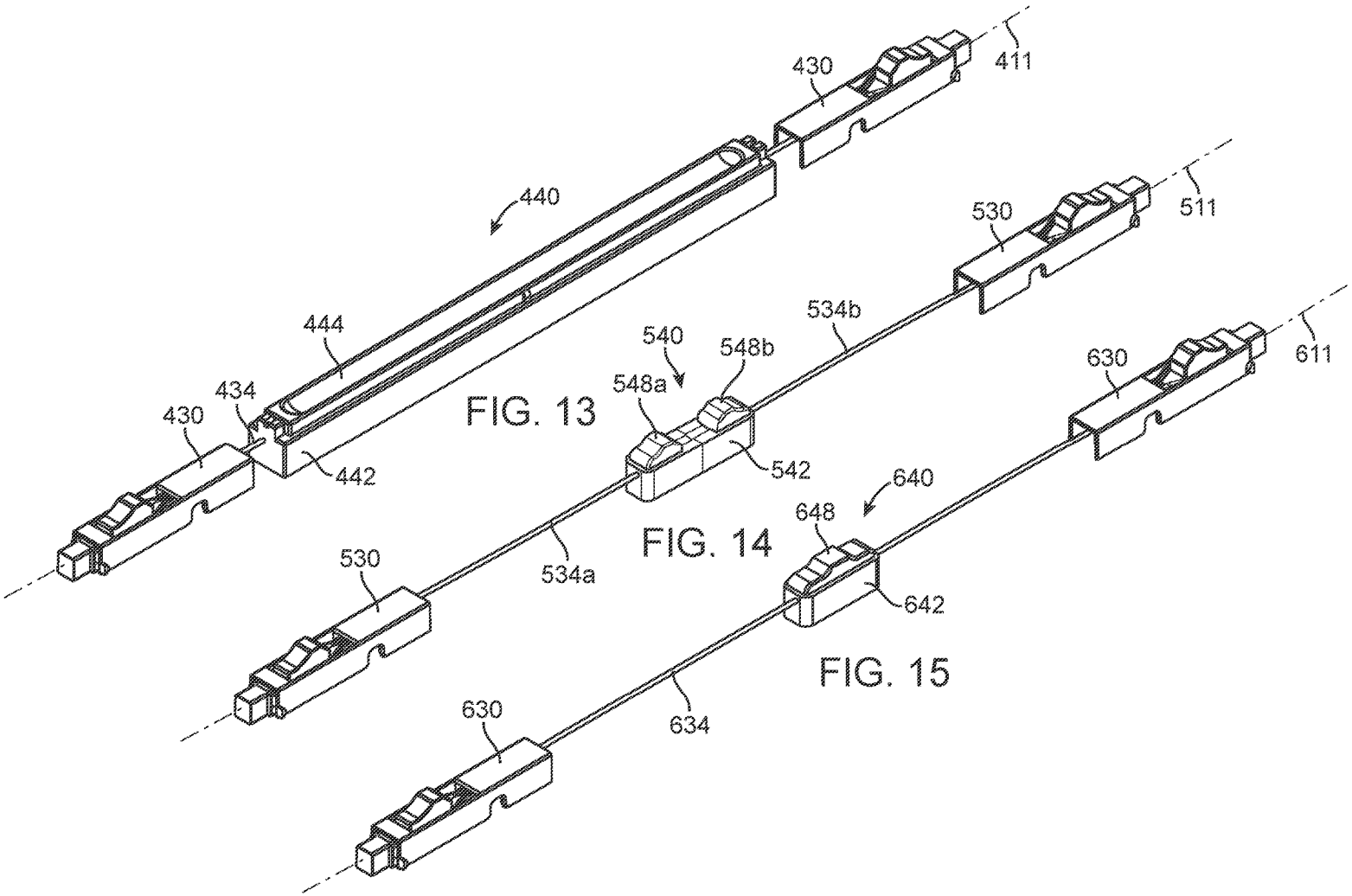
FIG. 13 depicts another illustrative embodiment of a tilt latch apparatus as described herein.
FIG. 14 depicts another illustrative embodiment of a tilt latch apparatus as described herein.
FIG. 15 depicts another illustrative embodiment of a tilt latch apparatus as described herein.

FIG. 13 depicts another illustrative embodiment of a tilt latch apparatus as described herein that includes a single common tilt latch retractor assembly 440 connected to a pair of latch bolt assemblies 430. The common tilt latch retractor assembly 440 includes, as described herein, a base 442 and a driver 444 which may, in one or more embodiments, be similar to those described above in connection with FIG. 9. Unlike the common tilt latch retractor assemblies described above, however, the common tilt latch retractor assembly 440 depicted in FIG. 13 may, in one or more embodiments, occupy more of the distance between the latch bolt assemblies 430 in the tilt latch apparatus. In one or more embodiments, the common tilt latch retractor assembly 440 of such a tilt latch apparatus may be described as occupying at least a majority of the distance between the latch bolt assemblies 430. Actuation of the driver 444 at any point along the length of the common tilt latch retractor assembly 440 may, in one or more embodiments, be used to retract the latch bolts in latch bolt assemblies 430.

In still other alternative embodiments, the common tilt latch retractor assemblies used in tilt latch apparatus as described herein may rely on a sliding or translational movement of a driver to retract the latch bolts of latch bolt assemblies. Such sliding or translational movement may be described as being in a direction that is aligned with the release rail axis of a release rail in which the common tilt latch retractor assembly is located.

FIG. 14 depicts one illustrative embodiment of a tilt latch apparatus as described herein that includes a common tilt latch retractor assembly 540 connected to a pair of latch bolt assemblies 530. The common tilt latch retractor assembly 540 includes a base 542 and a pair of drivers 548*a* and 548*b*. Movement of the drivers 548*a* and 548*b* towards each other along release rail axis 511 in, e.g., a pinching motion, may, in one or more embodiments, retract the latch bolts in the latch bolt assemblies 530. The common tilt latch retractor assembly 540 may, in one or more embodiments, be operably connected to the latch bolt assemblies 530 by actuator segments 534*a* and 534*b* (which, as described herein, may form different segments of a continuous actuator or may be separate and discrete actuators that are not continuous through the common tilt latch retractor assembly 540). In the depicted illustrative embodiment, for example, driver 548*a* may be connected to actuator 534*a*, while driver 548*b* may be connected to actuator 548*b*, although such a construction is not required.

FIG. 15 depicts one illustrative embodiment of a tilt latch apparatus as described herein that includes a common tilt latch retractor assembly 640 connected to a pair of latch bolt assemblies 630 through actuator 634 (which may, as described herein, be a continuous element or two segments, each of which is connected to the common tilt latch retractor assembly 640). The common tilt latch retractor assembly 640 includes a base 642 and a driver 648. Movement of the driver 648 along the release rail axis 611 may, in one or more embodiments, retract the latch bolts in the latch bolt assemblies 630. For example, the driver 648 may be moved first in one direction along release rail axis 611 to release the latch bolt assembly at one end of the tilt latch apparatus, followed by movement of the driver 648 in the opposite direction to release the latch bolt assembly at the opposite end of the tilt latch apparatus.

The tilt latch apparatus as described herein may provide for convenient methods of rotating a sash within a fenestration unit frame. In one illustrative embodiment depicted in FIG. 1A, methods of using the tilt latch apparatus as described herein may involve sliding a sash (e.g. an upper sash 12 in a double hung window) within a fenestration unit frame 16 such that a release rail 20 of the upper sash 12 is moved away from a frame member of the fenestration unit frame 16 to expose a frame edge of the release rail 20 of the upper sash 12.

With the frame edge of the release rail 20 of the upper sash 12 exposed, a user may move the latch bolts of latch bolt assemblies 30 located at opposite ends of the release rail 20 from their respective engagement positions to their respective retracted positions using a common tilt latch retractor assembly 40 as described herein. In particular, a user may employ the common tilt latch retractor assembly 40 with one hand to retract the latch bolts for both of the first and second latch bolt assemblies 30 inwardly toward the common tilt latch retractor assembly 40, leaving the user's other hand free to assist in controlling movement, e.g., rotation of the upper sash 12 about tilt axis 19 within the fenestration unit frame 16 after actuating the common tilt latch retractor assembly 40.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the tilt latch apparatus, sashes, fenestration units and methods of using the same are discussed herein with some possible variations described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A sash apparatus comprising:

a sash comprising a frame containing a panel therein, wherein the frame comprises a release rail located along one edge of the sash, wherein the release rail comprises a frame edge and a panel edge, wherein the panel edge faces an edge of the panel and the frame edge faces away from the panel edge, and wherein the release rail comprises an inner surface extending between the frame edge and the panel edge on one side of the sash and an outer surface facing extending between the frame edge and the panel edge on an opposite side of the sash;

a tilt latch channel located in the release rail along the frame edge, wherein the tilt latch channel extends along a release rail axis extending between a first end of the release rail and a second end of the release rail, wherein the tilt latch channel occupies only a portion of a width of the release rail as measured in a direction transverse to a plane defined by the panel;

a first latch bolt assembly in the tilt latch channel of the release rail proximate the first end of the release rail, wherein the first latch bolt assembly comprises a first latch bolt movable between an engagement position and a retracted position, wherein the first latch bolt extends past the first end of the release rail when in the engagement position;

a second latch bolt assembly in the tilt latch channel of the release rail proximate the second end of the release rail, wherein the second latch bolt assembly comprises a second latch bolt movable between an engagement position and a retracted position, wherein the second latch bolt extends past the second end of the release rail when in the engagement position;

a common tilt latch retractor assembly positioned in the tilt latch channel between the first latch bolt assembly and the second latch bolt assembly, wherein the common tilt latch retractor assembly is operably connected to both the first latch bolt assembly and the second latch bolt assembly and wherein the common tilt latch retractor assembly comprises a driver and a base, wherein the driver comprises a pushbutton that is configured to move downwardly towards the base during actuation of the common tilt latch retractor assembly, and wherein the common tilt latch retractor assembly is configured to retract the latch bolts for both the first latch bolt assembly and the second latch bolt assembly inwardly towards the common tilt latch retractor assembly from their respective engagement positions to their respective retracted positions when the driver is moved towards the base, wherein the common tilt latch retractor assembly is positioned within a release rail volume defined by the frame edge, panel edge, inner surface, and outer surface.

2. An apparatus according to claim 1, wherein the common tilt latch retractor assembly comprises:

a first actuator extending between the driver and the first latch bolt assembly, wherein the first actuator is operably attached to the first latch bolt assembly; and a second actuator extending between the driver and the second latch bolt assembly, wherein the second actuator is operably attached to the second latch bolt assembly.

3. An apparatus according to claim 2, wherein the first actuator and the second actuator are portions of a unitary actuator extending continuously from the first latch bolt assembly to the second latch bolt assembly.

4. An apparatus according to claim 1, wherein the common tilt latch retractor assembly comprises a first common tilt latch retractor assembly of a plurality of common tilt latch retractor assemblies positioned in the tilt latch channel between the first latch bolt assembly and the second latch bolt assembly.

5. An apparatus according to claim 1, wherein the sash comprises a movable window sash located in a window frame containing another sash, wherein the movable window sash is movable between an open position and a closed position in the window frame.

6. An apparatus according to claim 5, wherein the movable window sash comprises an upper sash of a double hung window unit.

7. A tilt latch apparatus for a release rail of a sash, the tilt latch apparatus comprising:

a housing configured for positioning in a tilt latch channel of a release rail of a sash, wherein the housing comprises a housing channel extending along a housing channel axis;

a first latch bolt assembly proximate a first end of the housing, wherein the first latch bolt assembly comprises a first latch bolt movable between an engagement position and a retracted position, wherein the first latch bolt extends past the first end of the housing when in the engagement position;

a second latch bolt assembly proximate a second end of the housing, wherein the second latch bolt assembly comprises a second latch bolt movable between an engagement position and a retracted position, wherein the second latch bolt extends past the second end of the housing when in the engagement position;

a common tilt latch retractor assembly positioned in the housing channel between the first latch bolt assembly and the second latch bolt assembly, wherein the common tilt latch retractor assembly is operably connected to both the first latch bolt assembly and the second latch bolt assembly and wherein the common tilt latch retractor assembly comprises a driver and a base, wherein the driver comprises a pushbutton that is configured to move downwardly towards the base during actuation of the common tilt latch retractor assembly, and wherein the common tilt latch retractor assembly is configured to retract the latch bolts for both the first latch bolt assembly and the second latch bolt assembly inwardly towards the common tilt latch retractor assembly from their respective engagement positions to their respective retracted positions when the driver is moved towards the base.

8. An apparatus according to claim 7, wherein the common tilt latch retractor assembly comprises:

a first actuator extending between the driver and the first latch bolt assembly, wherein the first actuator is operably attached to the first latch bolt assembly; and a second actuator extending between the driver and the second latch bolt assembly, wherein the second actuator is operably attached to the second latch bolt assembly.

9. An apparatus accordingly to claim 8, wherein the first and second actuators are configured to deflect downward along a depth of the housing channel when the common tilt latch retractor assembly is actuated.

10. An apparatus according to claim 8, wherein actuation of the common tilt latch retractor assembly comprises moving the driver between a rest position and a retraction position to move the latch bolts for both the first latch bolt assembly and the second latch bolt assembly inwardly towards the common tilt latch retractor assembly from their respective engagement positions to their respective retracted positions.

11. An apparatus according to claim 10, wherein moving the driver between the rest position and the retraction position comprises moving the driver in a direction transverse to the housing channel axis.

12. An apparatus according to claim 10, wherein the first actuator and the second actuator are portions of a unitary actuator extending continuously from the first latch bolt assembly to the second latch bolt assembly.

13. An apparatus according to claim 7, wherein the common tilt latch retractor assembly comprises a first common tilt latch retractor assembly of a plurality of common tilt latch retractor assemblies positioned in the housing channel between the first latch bolt assembly and the second latch bolt assembly.

14. A method comprising:

sliding a sash within a fenestration unit frame such that a release rail of the sash is moved away from a frame member of the fenestration unit frame, wherein the release rail comprises a frame edge facing the frame member and a panel edge facing away from the frame member, wherein the panel edge faces an edge of a panel contained in the sash, and wherein the release rail comprises an inner surface extending between the frame edge and the panel edge on one side of the sash and an outer surface facing extending between the frame edge and the panel edge on an opposite side of the sash;

moving a first latch bolt of a first latch bolt assembly in the release rail from an engagement position to a retracted position, wherein the first latch bolt extends past a first end of the release rail when in the engagement position;

moving a second latch bolt of a second latch bolt assembly in the release rail from an engagement position to a retracted position, wherein the second latch bolt extends past a second end of the release rail when in the engagement position;

wherein moving the first latch bolt and the second latch bolt from their respective engagement positions to their respective retracted positions comprises actuating a common tilt latch retractor assembly located within a release rail volume defined by the frame edge, panel edge, inner surface, and outer surface of the release rail, wherein the common tilt latch retractor assembly is operably connected to both the first latch bolt assembly and the second latch bolt assembly, and wherein actuating the common tilt latch retractor assembly comprises actuating the common tilt latch retractor assembly with one hand and wherein the actuating retracts the latch bolts for both the first latch bolt assembly and the second latch bolt assembly inwardly towards the common tilt latch retractor assembly from their respective engagement positions to their respective retracted positions at the same time; wherein actuating the common tilt latch retractor assembly further comprises moving a driver between a rest position and a retraction position to retract the latch bolts for both the first latch bolt assembly and the second latch bolt assembly inwardly towards the common tilt latch actuator from their respective engagement positions to their respective retracted positions, wherein the driver comprises a pushbutton and wherein moving the driver between the rest position and the retraction position comprises moving the pushbutton towards the panel edge of the release rail in a direction transverse to a release rail axis extending between the first and second latch bolt assemblies.

15. A method according to claim 14, wherein sliding the sash exposes the frame edge of the release rail.

* * * * *